US005470052A

United States Patent [19]

Asakawa et al.

[11] Patent Number: 5,470,052

[45] Date of Patent: Nov. 28, 1995

[54] OVERLAPPED TRANSFER-PREVENTING MECHANISM

[76] Inventors: Yoshiyuki Asakawa; Kazuyoshi Yamamura; Toshinori Muraoka; Masaru Hatano, all of c/o Mita Industrial Co., Ltd., 2-28, 1-chome, Tamatsukuri, Chuo-ku, Osaka, Japan

[21] Appl. No.: 287,242

[22] Filed: Aug. 8, 1994

Related U.S. Application Data

[62] Division of Ser. No. 67,441, May 25, 1993, Pat. No. 5,351, 945.

[30] Foreign Application Priority Data

| | | | |
|---|---|---|---|
| May 30, 1992 | [JP] | Japan | 4-163470 |
| Dec. 12, 1992 | [JP] | Japan | 4-352991 |
| Dec. 12, 1992 | [JP] | Japan | 4-352992 |

[51] Int. Cl.[6] ..... B65H 3/06

[52] U.S. Cl. ..... 271/118; 271/122; 271/125; 271/127

[58] Field of Search ..... 271/118, 122, 271/125, 126, 127

[56] References Cited

U.S. PATENT DOCUMENTS

| | | | |
|---|---|---|---|
| 4,627,607 | 12/1986 | Ishii | 271/122 |
| 4,801,134 | 1/1989 | Yokoyama et al. | 271/125 |
| 4,858,905 | 8/1989 | Weigel | 271/122 |
| 5,029,840 | 7/1991 | Haga et al. | 271/122 |
| 5,152,522 | 10/1992 | Yamashita | 271/122 |
| 5,172,899 | 12/1992 | Tajima | 271/122 |
| 5,228,676 | 7/1993 | Arai et al. | 271/126 |
| 5,316,285 | 5/1994 | Olson et al. | 271/122 |

FOREIGN PATENT DOCUMENTS

| | | | |
|---|---|---|---|
| 0031950 | 2/1988 | Japan | 271/272 |

*Primary Examiner*—H. Grant Skaggs
*Attorney, Agent, or Firm*—Harness, Dickey & Pierce

[57] ABSTRACT

The provision of the overlapped transfer-preventing mechanism having a pivot 5a integrated with the lower separating roll 5 which is variably separated from the upper separating roll 4 rotably driven, the lower separating rolls is rotable in a direction opposite to said paper supplying direction when the lift plate 37 is lifted up in a paper-supplying position.

2 Claims, 7 Drawing Sheets

OVERLAPPED TRANSFER-PREVENTING MECHANISM

This is a divisional application of U.S. application Ser. No. 08/067441 filed May 25, 1993, now U.S. Pat. No. 5,351,945 issued on Oct. 4, 1994.

BACKGROUND OF THE INVENTION

1. Field of the Invention

The present invention relates to an overlapped transfer-preventing mechanism provided in an image-forming apparatus and the like for preventing papers from being overlappedly transferred.

2. Description of the Prior Art

In an image-forming apparatus, papers for fixing an image formed are required and a plurality of said papers are usually piled on a cassette plate, which is detachably provided in said image-forming apparatus, in layers to be drawn out one by one by means of a paper-supplying roller.

In order to draw out the papers by means of said paper-supplying roller, it is necessary that the papers are pressed against the paper-supplying roller arranged thereabove at a front end portion thereof to apply a paper-supplying pressure to the papers. To this end, said cassette plate is risen on the paper-supplying roller at a front end thereof by means of an actuator such as a spring force or a motor and a cylinder device.

The papers drawn out by means of the paper-supplying roller are treated with a separating roll, which is arranged in the vicinity of the paper-supplying roller, to prevent an overlapped transfer thereof. Said separating roll comprises an upper separating roll, which is rotatably driven in the same manner together with the paper-supplying roller to be brought into contact with an upper surface of the papers, and a lower separating roll, which is brought into contact with a lower surface of the papers but not rotated in a paper-supplying direction, to prevent the papers from being overlappedly transferred by a difference between frictional resistances which the papers receive from both rolls. In short, said upper surface of the paper-supplying roller hardly receives said frictional resistance from the upper separating roll, which is rotatably driven in the same direction together with the paper-supplying roller, but said lower surface of the papers receives a comparatively large frictional resistance from the lower separating roll, which is not rotated in said paper-supplying direction, and thus, when two pieces or more of paper are transferred at the same time, a supply of lower paper is stopped by said difference between the frictional resistances.

With the above described separating roll, if the lower separating roll is brought into sliding contact with the lower surface of the papers always at the same position, it is biasedly worn, so that a surface-changing mechanism for rotating the lower separating roll by one rotation severalth by the use of an actuator, such as solenoid, after counting an appointed time is provided.

However, in the case where said actuator, such as solenoid, is used, problems have occurred in that not only the construction is complicated and the cost is increased but also the layout is reduced in degree of freedom.

In addition, in case of the manual paper-supply, it has been required to regulate an interval between the upper separating roll and the lower separating roll depending upon a kind of the papers. For example, in the case where the thick papers, such as OHP, are supplied, the lower separating roll is regulated so as to be lowered in height in order to increase said interval. Also in the case where the lower separating roll is regulated so as to be adjustable in height, it has been desired to provide said surface-changing mechanism simple in construction.

However, in the case where the large interval is set between both separating rolls, as above described, the papers enter too deeply to be engaged with a regist switch, whereby making a jam-display, according to circumstances, when the papers are set. Accordingly, it has been desired also that such the disadvantage is prevented from occurring.

However, in order to surely prevent the overlapped transfer and accurately supply the papers, as above described, the appointed interval must be set between the upper separating roll and the lower separating roll. However, both separating rolls are usually arranged at positions where they are not brought into contact with each other, so that the operation for regulating the interval between both separating rolls has been troublesome and took time. Accordingly, it has been desired not only in its manufacturing step but also in its aftercare step that such the disadvantage is solved.

SUMMARY OF THE INVENTION

The present invention has been achieved taking such the actual condition into consideration and it is an object of the present invention to provide an overlapped transfer-preventing mechanism capable of conducting a surface-change of separating rolls without, requiring an actuator, simple in construction, high in freedom in layout, inexpensive, capable of stopping papers at suitable positions in case of a manual paper-supply, or, capable of setting an interval between both separating rolls without requiring a troublesome regulating operation.

According to the present invention, means for solving the above described problems are constructed as follows:

In a first invention, an overlapped transfer-preventing mechanism provided in an image-forming apparatus, in which a paper-carrying plate with papers carried thereon is moved between an upper paper-supplying position and a lower paper-supplying position, is characterized in that the other separating roll corresponding to one rotatably driven separating roll is supported so that an interval between both separating rolls may be regulatable, a pivot integral with the other separating roll being provided with a gear, a ratchet corresponding to said gear being provided so as to be movable up and down, and a cam mounted on a pivot integral with a rising member rising said paper-carrying plate up to said upper paper-supplying position being interlocked with said ratchet through an interlocking member to rotate the other separating roll in a direction opposite to a paper-supplying direction by a rising operation of said rising member regardless of an up and down position of the other separating roll.

A second invention is characterized in that an upper portion of the ratchet according to said first invention is extended upward and said extended portion is set so that a front end of papers manually supplied may be engaged with the extended portion of the ratchet to stop said papers when the paper-carrying plate exists at a lower non-paper-supplying position.

In a third invention, a separating mechanism-cancelling device provided in an image-forming apparatus, in which a paper-carrying plate with papers carried thereon is moved between an upper paper-supplying position and a lower paper-supplying position, is characterized in that a pivot integral with the other separating roll energized to the side of one separating roll rotatably driven is provided with a spacer mounted on a position brought into contact with said one separating roll for setting an interval between one separating roll and the other separating roll.

A fourth invention is characterized in that a separating member is provided for separating said spacer from one separating roll by a moving operation of said paper-carrying plate according to said third invention.

A fifth invention is characterized in that said separating member according to said fourth invention is a lever member mounted on said pivot integral with the other separating roll and engaged with the paper-carrying plate by said moving operation of the paper-carrying plate to separate the spacer from one separating roll.

In a sixth inventions, a separating mechanism-cancelling device provided in an image-forming apparatus, in which a paper-carrying plate with papers carried thereon is moved between an upper paper-supplying position and a lower paper-supplying position, is characterized in that a pivot integral with the other separating roll energized to the side of one separating roll rotatably driven is provided with a one-way clutch making a rotation of said pivot in a paper-supplying direction impossible and a rotation of the pivot in a direction opposite to said paper-supplying direction possible, a rotation-promoting member rotating said one-way clutch in said direction opposite to the paper-supplying direction by a moving operation of said paper-carrying plate being provided, and a spacer mounted on the pivot and brought into contact with one separating roll to be energized being separated from one separating roll by means of said rotation-promoting member operated by said moving operation on of the paper-carrying plate.

A seventh invention is characterized in that the rotation-promoting member according to said sixth invention is a lever member mounted on a pivot integral with the other separating roll and engaged with the paper-carrying plate by the moving operation of the paper-carrying plate to rotate the one-way clutch in the direction opposite to the paper-supplying direction.

According to the first invention, the cam moves the ratchet upward or downward through the interlocking member by the upward or downward moving operation of the paper-carrying plate go rotate the gear in the direction opposite to the paper-supplying direction, whereby conducting the surface-change of the other separating roll. By suitably setting an up and down movable range of the ratchet, the surface-change can be conducted without objection even in the case where a gear integral with the other separating roll is changed tip and down in position.

According to the second invention, by extending the ratchet according to the first invention upward, the front end of the papers can be received by the extended portion of the ratchet and thus the papers can be prevented from entering too widely even in the case where the interval between both separating rolls is increased.

According to the third invention, by bringing the spacer into contact with one separating roll when assembled, the other separating roll mounted on the pivot, on which also the spacer is mounted, can be arranged at the appointed interval from one separating roll.

According to the fourth invention, when the papers have been used to be replenished on the paper-carrying plate or the papers are to be replaced or a power source is switched off and at that time the paper-carrying plate is moved, the separating member is operated to separate the spacer from one separating roll. Thus, the separating roll can be prevented from being plastically deformed and the suitable interval between both separating rolls can be always kept.

According to the fifth invention, the paper-carrying plate is brought into contact with the lever member during a movement thereof to separate the spacer from one separating roll by means of the lever member, whereby the separating roll can be prevented from being plastically deformed and the suitable interval between both separating rolls can be always kept.

According to the sixth invention, when the papers have been used to be replenished on the paper-carrying plate or the papers are to be replaced or a power source is switched off and at that time the paper-carrying plate is moved, the rotation-promoting member is operated to rotate the one-way clutch and rotate the pivot of the one-way clutch in the direction opposite to the paper-supplying direction, whereby changing places where the other separating roll is brought into slidable contact with the papers and thus preventing the other separating roll being biasedly worn and additionally the spacer is separated from one separating roll to prevent the separating roll also from being plastically deformed.

According to the seventh invention, the paper-carrying plate is brought into contact with the lever member during a movement thereof to rotate the one-way clutch and rotate the pivot of the one-way clutch in the direction opposite to the paper-supplying direction, whereby changing places where the other separating roll is brought into slidable contact with the papers and thus preventing the other separating roll being biasedly worn and additionally the spacer is separated from one separating roll by means of the lever to prevent the separating roll also from being plastically deformed.

BRIEF DESCRIPTION OF THE DRAWINGS

FIG. 2 (B) is a diagram showing a condition that said cassette plate is moved downward to a paper-drawing position;

DETAILED DESCRIPTION OF THE PREFERRED EMBODIMENTS

The preferred embodiments of the present invention will be below in detail described with reference to the drawings.

Figure 1:
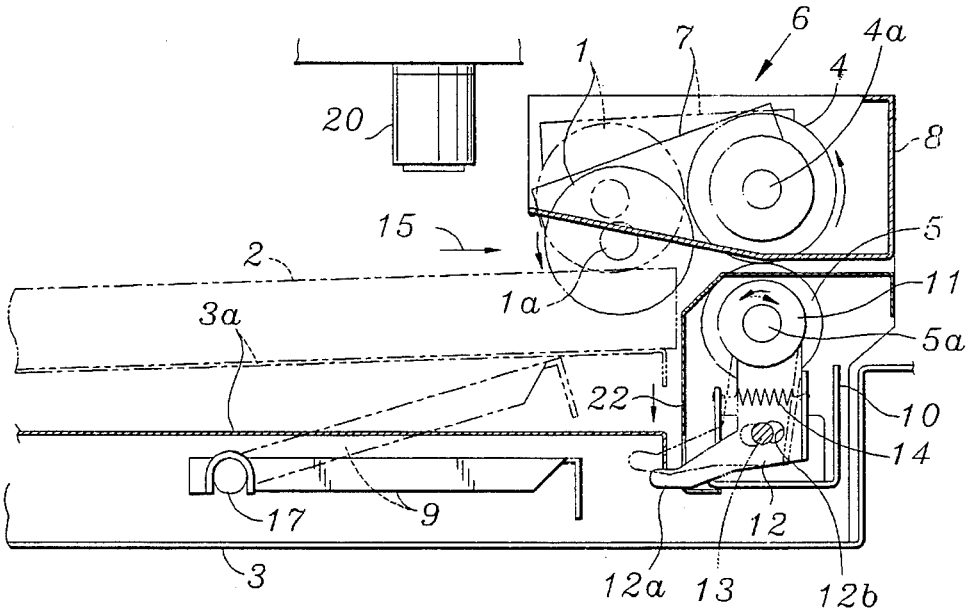
FIG. 1 is a sectional view showing principal parts in a first preferred embodiment of an overlapped transfer-preventing mechanism according to the present invention.

FIGS. 1 to 4 relates to the first preferred embodiment. FIG. 1 shows an overlapped transfer-preventing mechanism of an image-forming apparatus. Reference numeral 1 designates a paper-supplying roller brought into contact with an upper surface of papers 2 piled lip on a cassette plate 3*a*, which is provided within a cassette case 3, which is detachably provided in an image-forming apparatus 21 (refer to FIG. 4), so as to be movable up and down in layers to supply said papers 2 in a paper-supplying direction. Reference numeral 4 designates an upper separating roll as one separating roll rotatably driven in said paper-supplying direction together with said paper-supplying roller 1 and reference numeral 5 designates a lower separating roll incapable of being rotated in the paper-supplying direction as the other separating roll for putting the papers 2 between it and said upper separating roll to prevent the papers 2 from being overlappedly transferred, the upper separating roll 4 and said lower separating roll 5 constituting paper-supplying means 6.

A pivot 5*a* integral with the lower separating roll 5 is provided with a one-way clutch 11 making a rotation of the lower separating roll 5 in the paper-supplying direction impossible and a rotation of the lower separating roll in a direction opposite to the paper-supplying direction possible and said one-way clutch 11 is provided with a lever member 12 engaged with said cassette plate 3*a* by a movement of the cassette plate 3*a* to a lower drawing-out position (shown by a full line) to rotate the one-way clutch 11 in said direction opposite to the paper-supplying direction.

With such the construction, in the case where the papers 2 are to be replenished on the cassette plate 3*a* or replaced, when the cassette plate 3*a* is once moved to said lower position, the cassette plate 3*a* is engaged with a front end 12*a* of said lever member 12 to push down the lever member 12, whereby rotating the one-way clutch 11 integral with the lever member 12 in the direction opposite to the paper-supplying direction. At this time, the lower separating roll 5 is rotated in the direction opposite to the paper-supplying direction by the one-way clutch 11 to change a position where the lower separating roll 5 is brought into slidable contact with a lower surface of the papers 2 [refer to FIG. 2 (A), (B)], whereby preventing the lower separating roll from being biasedly worn. In short, the lower separating roll 5 can be rotated little by little in the direction opposite to the paper-supplying direction by a downward movement of the cassette plate 3*a*, a layout being able to be improved in degree of freedom by a simple construction, and an inexpensive surface-changing mechanism of separating roll being able to obtain.

Figure 3:
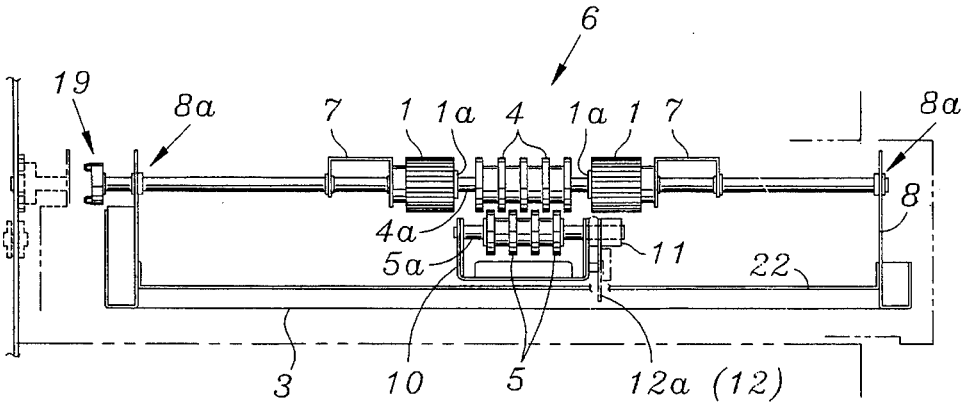
FIG. 3 is a front view showing paper-supplying means.

In more detail describing, the upper separating roll 4 is made of rubber and five sets of upper separating roll 4 are fixedly arranged at regular intervals in a central portion of a pivot 4*a* pivoted between pivoting portions 8*a*, 8*a* of a frame 8 incorporated in said cassette case 3, four sets of lower separating roll 5 being oppositely arranged between the respective upper separating rolls 4, and pivots 5*a* of the lower separating rolls 5 being pivoted on a bracket 10 standing on a bottom portion of said frame 8, as shown in FIG. 3.

Figure 2A:
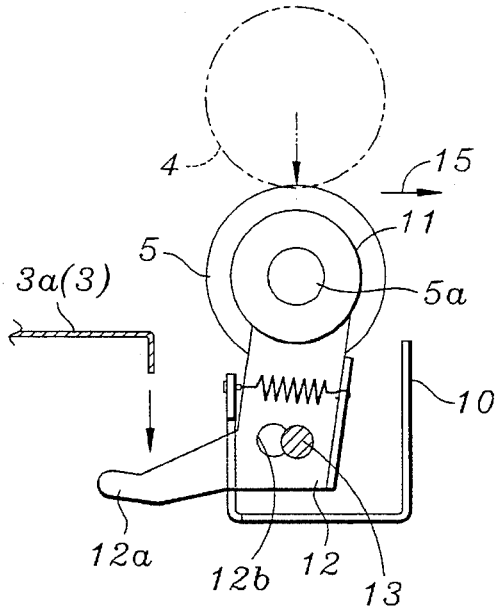
FIG. 2 (A) is a diagram showing a condition that a cassette plate and a lever member correspond to each other under a paper-supplying condition.

The one-way clutch 11, of which pivot 5*a* is incapable of rotating in the paper-supplying direction but capable of rotating in the direction opposite to the paper-supplying direction, is mounted on one end of the pivot 5*a*, the one-way clutch 11 being provided with the downward lever member 12 fixedly mounted thereon, a lower front end portion 12*a* of the lever 12 being protruded from a lower case member 22 (refer to FIG. 1) to be faced to a lower portion of a front end of the cassette plate 3*a*, an axis member 13, which is fixedly mounted on said bracket 10, being inserted through a long hole 12*b* opened in a lower central portion of the lever member 12 to regulate a back and forth vibrating width of the lever member 12, and a spring 14 being extended between the lever member 12 and the bracket 10 to energize said front end portion 12*a* of the lever member 12 to a watch and wait position corresponding to said lower portion of the cassette plate 3*a* existing in an upper paper-supplying position under the free condition, as shown in FIG. 2(A).

Figure 2B:
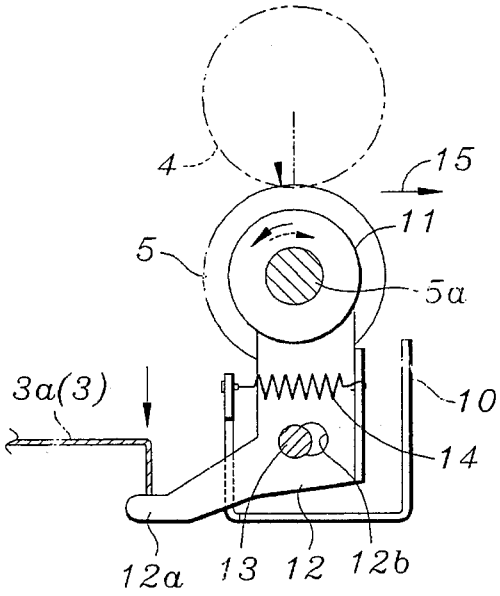

Under such the positional condition, in the case where for example the papers 2 within the cassette case 3 have been used to be replenished or the papers 2 are exchanged, when the cassette plate 3*a* is moved downward, the front end of the cassette plate 3*a* is engaged with the front end portion 12*a* of the lever member 12 to rotate the one-way clutch 11 counterclockwise, as shown in FIG. 2(B). At this time, also the lower separating roll 5 integrated with the one-way clutch 11 through the pivot 5*a* is rotated in the same direction. Thus, a point where the lower separating roll 5 is brought into slidable contact with the papers 2 (shown by a mark ▽) is moved in the direction opposite to the paper-supplying direction shown by an arrow 15. Accordingly, at every time when the cassette plate 3*a* is moved downward, said point where the lower separating roll 5 is brought into slidable contact with the papers 2 is slightly moved and thus the lower separating roll 5 can be surely prevented from being biasedly worn. In addition, although a size of said long hole 12*b* is set so that the lower separating roll 5 may be rotated by 1/45 turn (about 8°) per one swing of the lever member 12 in the present preferred embodiment, it goes without saying that said size of the long hole 12*b* may be suitably set and changed depending upon a kind of apparatus.

On the other hand, the cassette plate 3*a* (refer to FIG. 1) is risen by means of a front end of a pushing-up member 9 fixedly mounted on a supporting axis 17, which is rotated by means of a motor through a transmission mechanism pivoted on the bottom portion of the cassette case 3 through a bracket and the like (not shown), at a base portion thereof to be locked at the upper paper-supplying position shown by a two-dot chain line in FIG. 1, whereby slightly pushing up the paper-supplying roller 1 by the papers 2 to apply a paper-supplying pressure to the papers 2, during the power source is switched on. And, when for example the power source is switched off or the papers 2 have been used or the papers 2 are exchanged, said lock is cancelled and thus the cassette plate 3*a* is moved downward to the lower drawing-out position shown by the full line to push down the front end portion 12*a* of the lever member 12 in the above described manner, whereby rotating the lower separating roll 5 in the direction opposite to the paper-supplying direction.

On the other hand, as for the upper separating roll 4, a connecting member 19 (refer to FIG. 3) mounted on one end of the pivot 4*a* pivoted between the pivoting portions 8*a*, 8*a* of the frame 8 is connected with a driving system provided in a body of an image-forming apparatus 21 when the cassette case 3 was inserted, the pivot la of the respective paper-supplying rollers 1 being pivoted on a bracket 7 swingably supported by the pivot 4*a* of the upper separating roll 4, both pivots 1*a*, 4*a* being interlocked through a gear, the paper-supplying rollers 1, 1 being brought into contact with the upper surface of the papers 2 to be moved to the upper position shown by the two-dot chain line from the lower position shown by the full line in FIG. 1 by the upward movement of the cassette case 3 to give a sufficient paper-supplying pressure to the papers 2 by their own weight, and the upper separating roll 4 being rotatably driven in the paper-supplying direction together with the paper-supplying rollers 1, 1 when a copying-starting button is switched on. In addition, referring again to FIG. 1, reference numeral 20 designates a visual sensor for detecting an up and down position off the cassette case 3.

Figure 4:
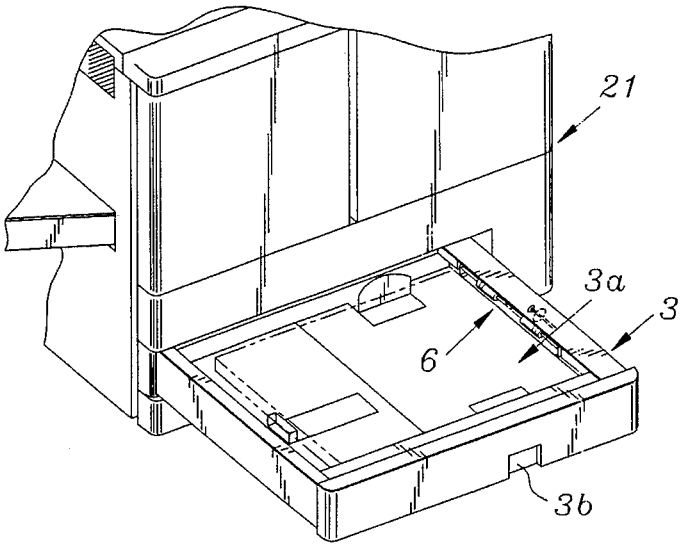
FIG. 4 is a perspective view showing an image-forming apparatus.

With the surface-changing mechanism of the separating roll for preventing the overlapped transfer having the above described construction, at first when the cassette case 3 is drawn out to carry the papers 2 on the cassette plate 3*a*, as shown in FIG. 4, the front end portion 12*a* of the lever member 12 is pushed down by the lower portion of the front end of the cassette plate 3*a* to be moved downward to the position shown by the full line in FIG. 2(B). Thus, the one-way clutch 11 is rotated counterclockwise to rotate the lower separating roll 5 together with the pivot 5*a* in the same direction, and at this time, the position where the lower separating roll 5 is brought into slidable contact with the papers 2 is moved from the position shown by the mark ▽ in FIG. 2(A) to the position shown in FIG. 2(B).

Then, when the cassette case 3 is inserted in said body of said image-forming apparatus 21 and the power source is switched on, the pushing-up member 9 is rotated upward to rise the front end portion of the cassette plate 3*a* (refer to the two-dot chain line in FIG. 1), the upper surface of the papers 2 being brought into contact with the paper-supplying roller 1 to finish the preparation for the paper-supply, and the paper-supply being started when the copying-starting button is pushed to carry out the copying operation. On the other hand, the front end portion 12*a* of the lever member 12 is returned to the position shown by the two-dot chain line by a tension of said spring 14 when the cassette plate 3*a* is risen. However, at this time, the one-way clutch 11 is rotated clockwise but a rotating power is not given to the pivot 5*a* and thus the pivot 5*a* is not rotated.

In the above described copying operation, both the paper-supplying roller 1 and the upper separating roll 4 are rotated in the paper-supplying direction to be brought into contact with the upper surface of the papers 2, whereby transferring the papers 2 in the paper-supplying direction 15, while, the lower separating roll 5 brought into contact with the lower surface of the papers 2 is connected with the one-way clutch 11 and said axis member 13 is engaged with one end of the long hole 12*b* of the lever member 12 to regulate the clockwise rotation of the lever member 12, so that the lower separating roll 5 is not rotated in the paper-supplying direction, in short clockwise, by a clutching function of the lever member 12. Thus, a larger slidable contact resistance is given to the lower surface of the papers 2 to treat the papers 2, whereby preventing the papers 2 from being overlappedly transferred.

When the papers 2 have been used, it is detected by said visual sensor arranged separately to move the cassette plate 3*a* downward to the lower drawing-out position. At this time, the front end portion 12*a* of the lever member 12 is pushed down by the front end portion of the cassette plate 3*a* (refer to the full line in FIG. 1) and the lower separating roll 5 is rotated counterclockwise by 1/45 turn to move the point, at which the lower separating roll 5 is brought into slidable contact with the lower surface of the papers 2, as much as that [refer to FIG. 2(A), (B)]. Thus, the lower separating roll 5 can be prevented from being biasedly worn. In addition, also in the case where the papers 2 are exchanged, when a hand is put on a handle 3*b* of the cassette case 3 (refer to FIG. 4), the cassette plate 3*a* is moved downward to the drawing-out position, so that the front end portion 12*a* of the lever member 12 is pushed down similarly to rotate the lower separating roll 5 counterclockwise by 1/45 turn.

As above described, the point, at which the lower separating roll 5 is brought into slidable contact with the papers 2, can be changed little by little through the one-way clutch 11 by the downward movement of the cassette plate 3*a* when the papers 2 are replenished or exchanged and thus the lower separating roll 5 can be surely prevented from being biasedly worn. The degree of freedom in layout can be improved and the cost can be reduced without requiring the actuator, such as solenoid and motor, by such the simple construction. In addition, according to the present preferred embodiment, an advantage occurs in that the cassette plate is automatically elevated by means of a motor, so that also the surface-change of the separating roll can be automatically carried out. By the way, although not shown, the surface-changing mechanism of separating roll according to the present invention can be applied also to a manual paper-supplying portion, and, in this case, it is sufficient that a contrarotating roll is adapted to be rotated when a by-pass lift is descended.

Figure 5:
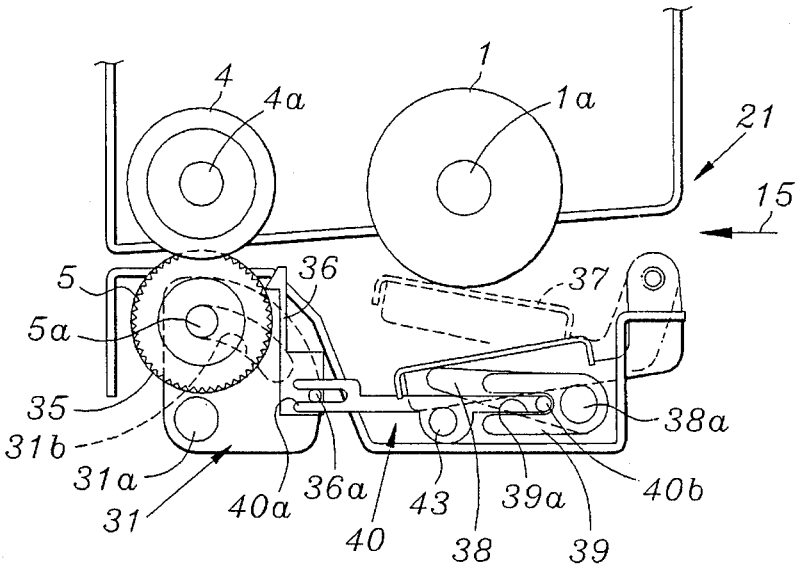
FIG. 5 is a sectional view showing principal parts in a second preferred embodiment of an overlapped transfer-preventing mechanism according to the present invention.
Figure 6:
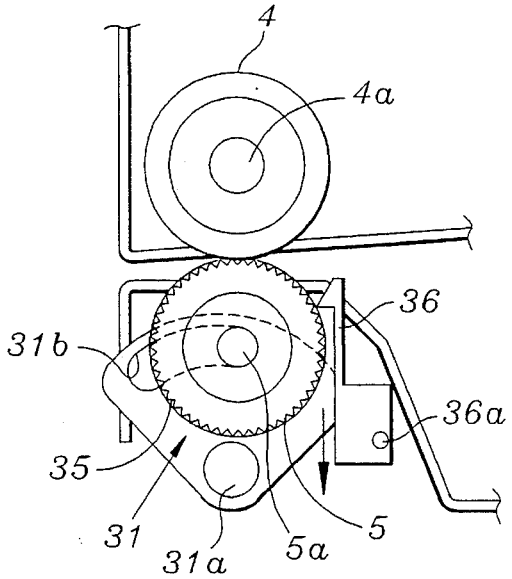
FIG. 6 is a sectional view showing principal parts when an interval between an upper separating roll and a lower separating roll is set so as to be large.
Figure 7:
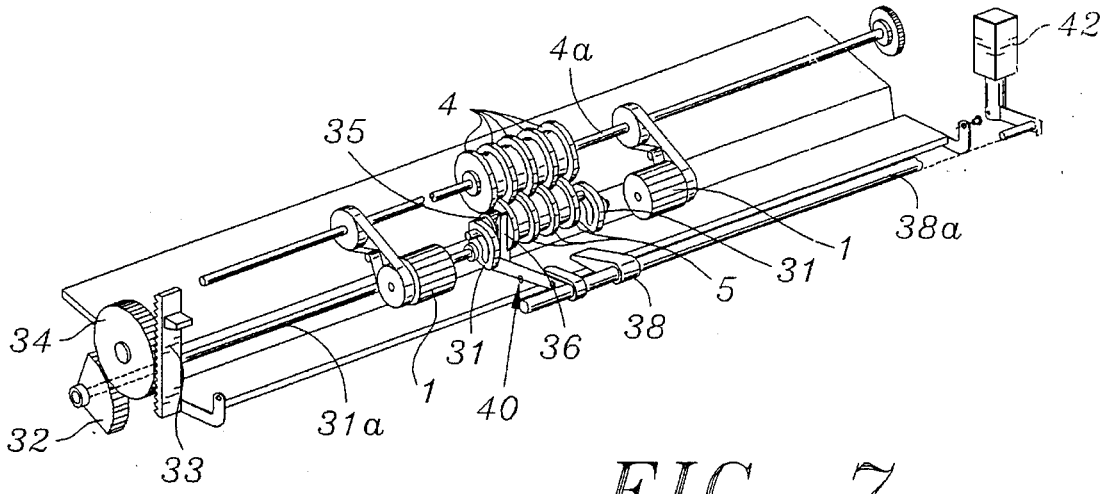
FIG. 7 is the whole perspective view showing said principal parts.
Figure 8:
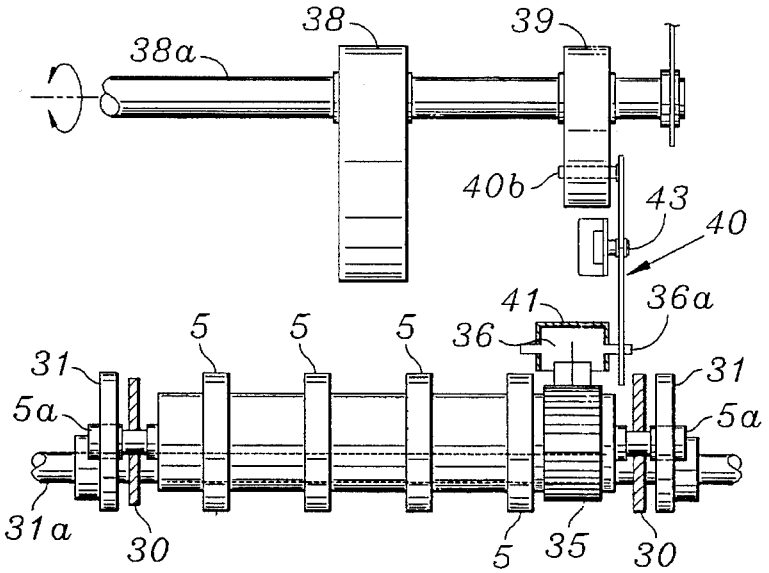
FIG. 8 is a plan view showing the principal parts.

FIGS. 5 to 8 show the second preferred embodiment relating to an image-forming apparatus of manual paper-supplying type 21. Reference numeral 31 designates a segment bracket for changeably regulating a height of the pivot 5*a* of the lower separating roll 5. Said segment bracket 31 is fixedly mounted on a pivot 31*a*, the pivot 5*a* of the lower separating roll 5 being idly supported in a guide hole 31*b* formed in a circumferential portion so that a radius may be changed relatively to said pivot 31*a*, and the pivot 5*a* being adapted to be regulated in up and down position by a rotating operation of the segment bracket 31. In more detail describing, the pivot 5*a* is guided in the up and down direction by means of guide plates 30, 30 standing inside both segment brackets 31, 31 (refer to FIG. 8), while, the pivot 31*a* is provided with a segment gear 32 at an outer end thereof, as shown in FIG. 7, and a rack gear formed inside of an operating member 33, which is projected out of a body (not shown) of said image-forming apparatus 21 to be slidingly operated up and down, is interlocked with the segment gear 32 through a pinion 34.

With such the construction, an interval between the upper separating roll 4 and the lower separating roll 5 can be regulated by operating said operating member 33 depending upon a thickness of the papers 2. FIG. 5 shows the case where said interval is reduced. The operating member 33 exists in an upper position shown in FIG. 7 and the interval is increased, as shown in FIG. 6, when the operating member 33 is descended to a lower position.

The pivot 5*a* of the lower separating roll 5, which is adapted to be changed in up and down position, as above described, is provided with a surface-changing gear 35 and a ratchet 36, which is movable up and down, corresponding to said gear 35, a cam 39 mounted on a pivot 38*a* integrated with a rising member 38 pushing up a lift plate (paper-carrying plate) 37 being interlocked with said ratchet 36 through an interlocking member 40, and the lower separating roll 5 being adapted to be rotated in the direction opposite to the paper-supplying direction regardless of the up and down position thereof by a lift plate-pushing-up operation of said rising member 38. In more detail describing, the ratchet 36 is guided in a guide member 41 (refer to FIG. 8) having an almost ⊐letter-shaped section and standing on the body in the up and down direction slidably up and down, and a U letter-shaped groove 40*a* formed at one end of said interlocking member 40 is slidably put on a projection 36*a* protrudedly formed on a lower lateral side of the ratchet 36, (refer to FIG. 5) while a projection 40*b* protruded from the other end of the interlocking member 40 is slidably put in a U letter-shaped groove 39*a* of said cam 39 fixedly mounted on said pivot 38*a* of the rising member 38 at a base portion thereof and the interlocking member 40 is pivoted on the body by means of a pin shaft 43 at a central portion thereof, in addition, reference numeral 43 in FIG. 7 designates an actuator for rotating the pivot 38*a* to ascend/descend said lift plate 37.

With such the construction, when the pivot 38*a* is rotated clockwise to push up the lift plate 37 (refer to two-dot chain line in FIG. 5), the ratchet 36 is moved downward to rotate the gear 35 clockwise and also the lower separating roll 5 in the same direction, in short the direction opposite to the paper-supplying direction 15, whereby carrying out the surface-changing. On the other hand, by operating the operating member 33, the gear 35 can be rotated by the catcher 36 and thus the surface-changing of the lower separating roll 5 can be carried out similarly even when the lower separating roll 5 was descended, as shown in FIG. 6.

Figure 9:
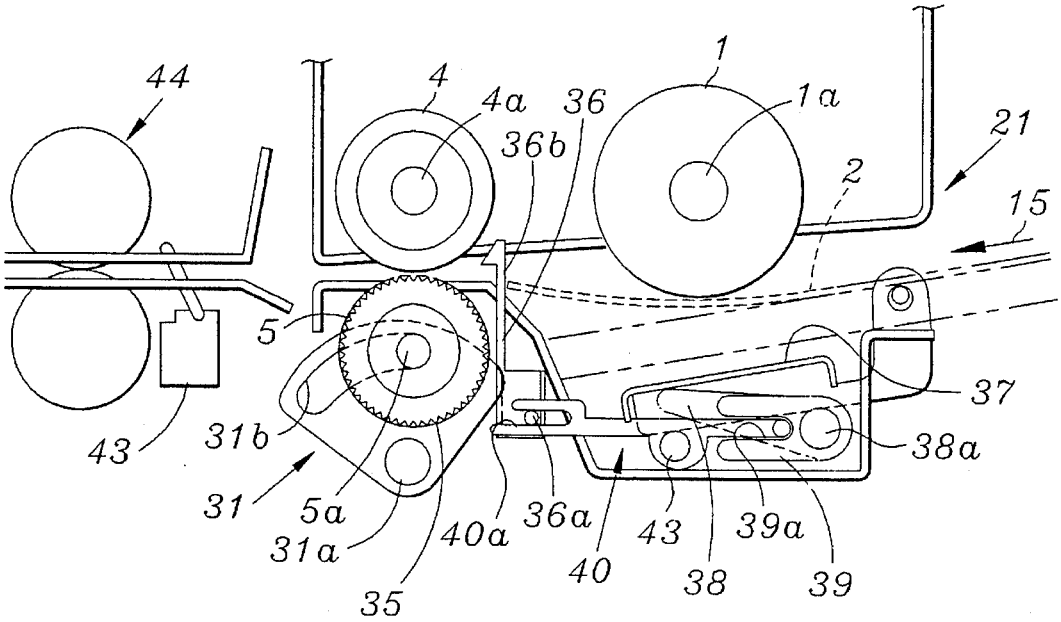
FIG. 9 is a sectional view showing principal parts under a condition that a paper-carrying plate exists at a lower non-paper-supplying position in a third preferred embodiment.
Figure 10:
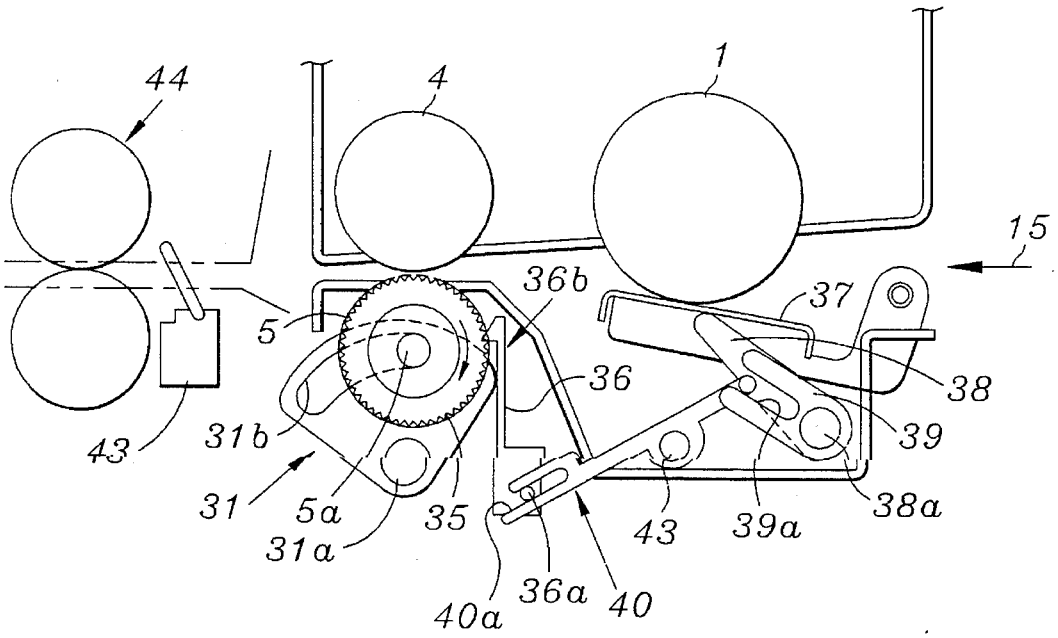
FIG. 10 is a sectional view showing said principal parts under a condition that said paper-carrying plate exists at an upper paper-supplying position.

FIGS. 9 and 10 show the third preferred embodiment, in which the papers 2 can be prevented from being excessively pushed in at the front end thereof when the distance between the upper separating roll 4 and the lower separating roll 5 is designed so as to be comparatively large. An upper portion of the ratchet 36 is extended upward to stop the papers 2 by means of an extended portion 36*b* when the lift plate 37 exists at the lower non-paper-supplying position (refer to FIG. 9). With such the construction, the front end of the papers 2 can be prevented from being detected by a regist switch 43 by mistake to make a jam-display. In addition, also in this case, when the lift plate 37 is pushed up (refer to FIG. 10), the surface-changing of the lower separating roll 5 is carried out similarly. Referring to FIGS. 9 and 10, reference numeral 44 designates a pair of regist rollers, that is an upper regist roller and a lower regist roller.

Figure 11:
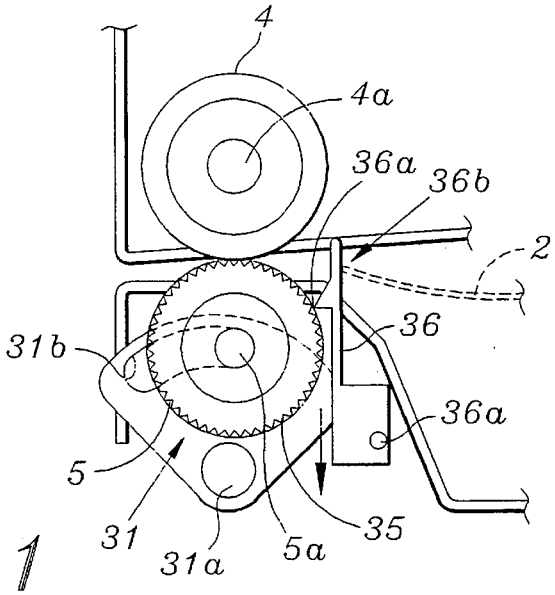
FIG. 11 is a sectional view showing an example in which a ratchet is provided with an extended portion in an upper portion thereof.

Furthermore, said extended portion 36*b* of the ratchet 36 may be provided above ratchet teeth 36*a*, as shown in FIG. 11.

FIGS. 12 to 16 show the fourth preferred embodiment. Reference numeral 46 designates a spacer made of POM resins rotatably supported by the pivot 5*a* integrated with the lower separating roll 5, reference numeral 47 designating a frame member mounted on an end portion of an inside of the cassette case 3, reference numeral 48 designating a bracket rotatably supporting the pivot 5*a*, and a projected end 48*a* of said bracket 48 being pivoted on a pin shaft 49 fixedly mounted on said frame member 47 and energized clockwise by means of a pair of springs 50 (refer to FIG. 15) to bring an outer circumferential surface of said spacer 46 into contact with the upper separating roll 4. Thus, the lower separating roll 5 is provided at the appointed distance from the upper separating roll 4 and the troublesome regulating operation for the distance between both separating rolls 4, 5 is not required in not only the manufacturing step but also the aftercare step.

Reference numeral 51 designates a lever member, which is engaged with the cassette plate 3*a* to be moved counterclockwise when the cassette plate 3*a* is moved from the upper paper-supplying position to the lower non-paper-supplying position, a pin 52 projected from the bracket 48 being idly engaged with a rotation-stopping lateral long hole 51*a* opened below said lever member 51. Reference numeral 53 designates a one-way clutch rotated in the same direction by the lever member 51 and mounted on the pivot 5*a* so that the pivot 5*a* may be rotated merely in the direction opposite to the paper-supplying direction. Thus, in the case where for example the papers 2 have been used to be replenished on the cassette plate 3*a* or the papers 2 are exchanged, when the cassette plate 3*a* is once moved to the lower non-paper-supplying position, the cassette plate 3*a* is engaged with the lever member 51 to rotate the lever member 51 counterclockwise at first and then rotate the lower separating roll 5 integrated with the pivot 5*a* counterclockwise through said one-way clutch 53 (refer to FIG. 13) and thus change the position where the lower separating roll 5 is brought into slidable contact with the lower surface of the papers 2, whereby preventing the lower separating roll 5 from being biasedly worn. In addition, in this case, the lever member 51 functions as a rotation-promoting member rotating the one-way clutch 53 in the direction opposite to the paper-supplying direction.

Figure 14:
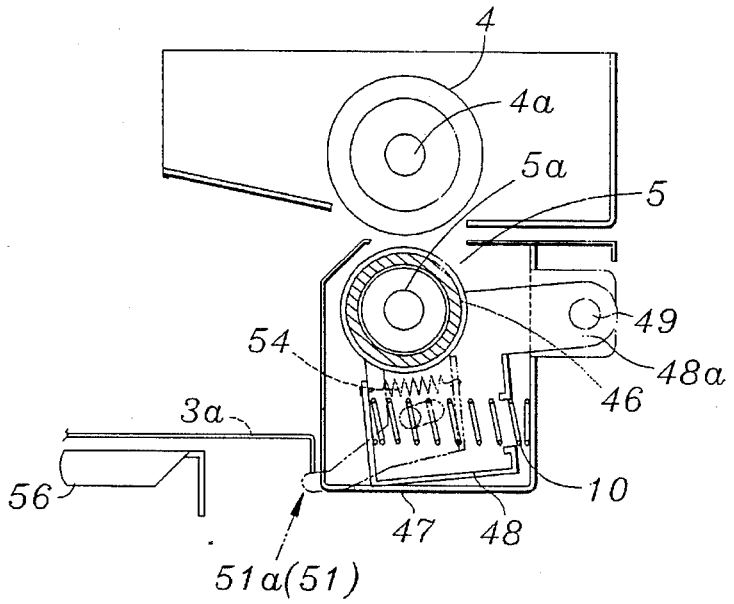
FIG. 14 is a sectional view showing a condition that a spacer was separated from one separating roll.

Subsequently, when the cassette plate 3*a* is further descended to rotate the lever member 51 until an end portion of said long hole 51*a* of the lever member 51 is engaged with said pin 52 of the bracket 48, the bracket 48 is rotated counterclockwise together with the lever member 51 around said pin shaft 49 with compressing said springs 50 to move the spacer 46 and the lower separating roll 5 downward, whereby separating the spacer 46 from the upper separating roll 4 and preventing the upper separating roll 4 from being deformed (refer to FIG. 14). In addition, in this case, the lever member 51 functions as a separating member separating the spacer 46 from the upper separating roll 4.

The cassette plate 3*a* exists at the lower non-paper-supplying position also when for example the apparatus is packed up or suspended for a long time and accordingly the spacer 46 is separated from the upper separating roll 4 and thus the upper separating roll 4 can be surely prevented from being plastically deformed.

Figure 16:
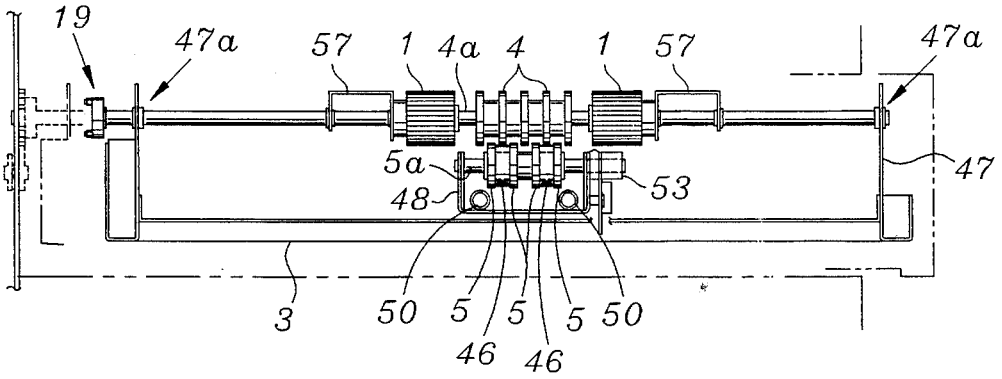
FIG. 16 is a front view showing a condition that a paper-supplying roller, the separating rolls and the spacer are arranged.
Figure 15:
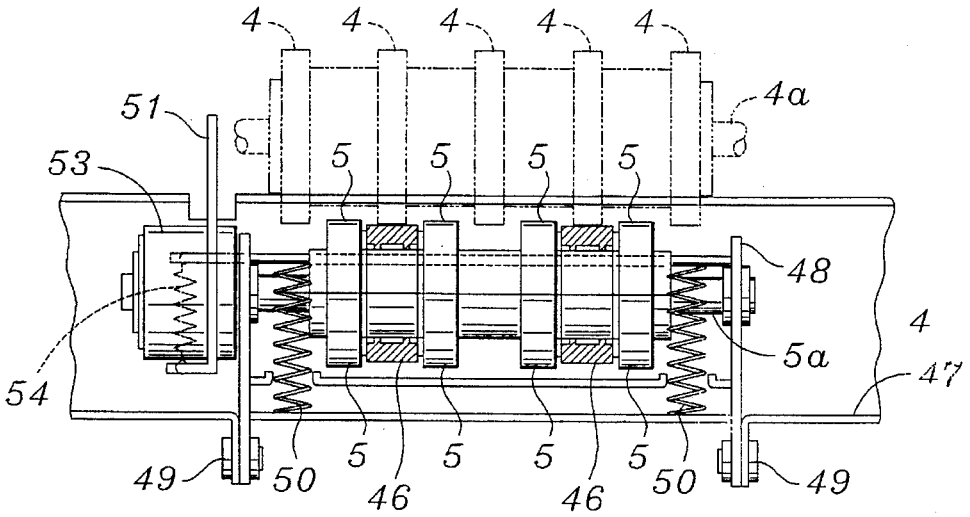
FIG. 15 is a partially sectioned front view showing a condition that said spacer is brought into contact with said one separating roll.

In more detail speaking, as shown in FIGS. 15, 16, five sets of upper separating roll 4 are fixedly arranged at regulating intervals in the central portion of the pivot 4*a* pivoted between pivoting portions 47*a*, 47*a* of the frame member 47 incorporated in the cassette case 3, a pair of spacers 46, 46 being arranged corresponding to a pair of inside upper separating rolls 4, 4, four sets of lower separating rolls 5 arranged on both sides of the respective spacers 46 being arranged between the upper separating rolls 4, respectively, and the respective spacers 46 being supported rotatably relatively to the pivot 5*a* supported by the bracket 48 energized upward while the respective lower separating rolls 5 are fixedly mounted on the pivot 5*a*, so that the lower separating roll 5 can be provided at the appropriate distance from the upper separating roll 4 by bringing the both spacers 46 into contact with the upper separating rolls 4, 4.

A one-way clutch 53 is fixedly mounted on one end of the pivot 5*a*, said one-way clutch 53 being provided with the downward lever member 51 fixedly mounted thereon (refer to FIG. 12), and the lower front end portion 51*b* of the lever member 51 being faced to the lower portion of the front end of the cassette plate 3*a* while the pin 52 fixedly provided on the bracket 4*a* is inserted through the long hole 51*a* opened at a center of the lower portion of the lever member 51 to regulate a back and forth swinging width of the lever member 51 and a return spring 54 is extended between the lever member 51 and the bracket 48 to energize the front end portion 51*b* of the lever member 51 to the watch and wait position corresponding to the lower portion of the cassette plate 3*a* existing at the upper paper-supplying position under the free condition.

On the other hand, the bracket 48 rotatably supporting the pivot 5*a* energizes the lower separating roll 5 and the spacer 46 toward the upper separating roll 4 by means of a pair of springs 50 provided between the bracket 48 and the frame member 47 in the above described manner. Since a spring force of the springs 50 is stronger than that of said return spring 54 of the lever member 51, a two-step operation can be continuously and surely carried out so that the condition that the spacers 46 are engaged with the upper separating rolls 4 may be kept during the time when the one-way clutch 53 is being rotated widen the cassette plate 3*a* is descended and the pin 52 may be engaged with the long hole 51*a* of the lever member 51 to swing the bracket 48 counterclockwise, whereby separating the spacers 46 from the upper separating rolls 4 when the cassette plate 3*a* was further descended. In addition, although a size of the long hole 51*a* and the like are set so that the lower separating roll 5 may be rotated by 1/45 turn (about 8°) per one swing of the lever member 51 in the present preferred embodiment, it goes without saying that said size of the long hole 51*a* and the like may be suitably set and changed.

Figure 12:
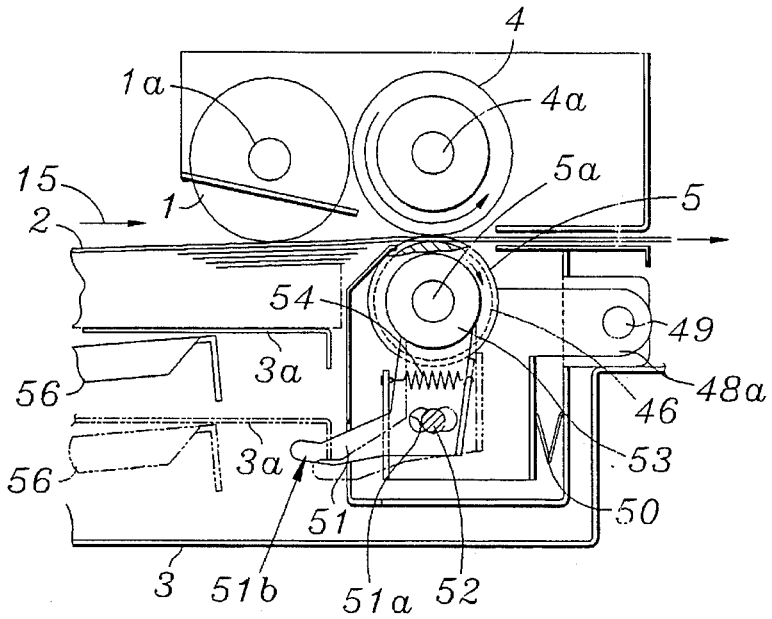
FIG. 12 is a sectional view showing a fourth preferred embodiment.
Figure 13:
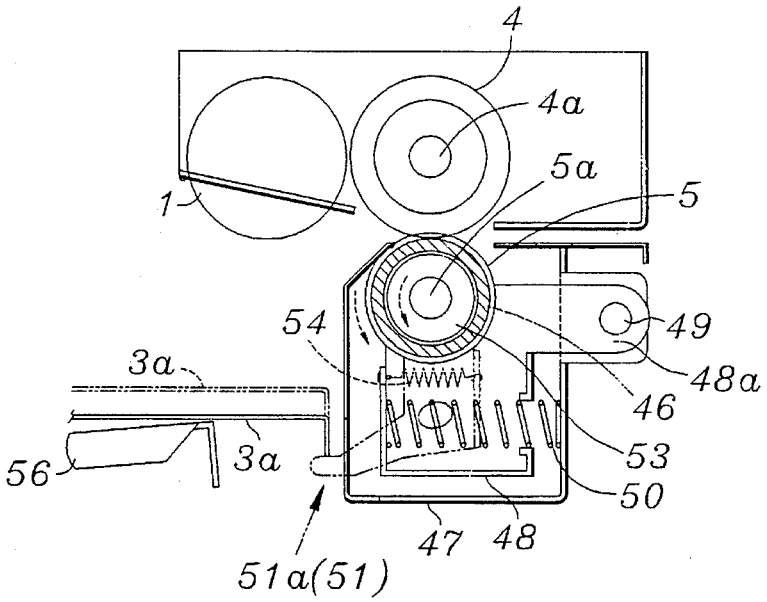
FIG. 13 is a sectional view showing a condition that the other separating roll was surface-changed.

On the other hand, the cassette plate 3*a* (refer to FIG. 12) is risen by means of a pushing-up member 56, which is rotated by means of a motor provided on the bottom portion of the cassette case 3 to be locked at the upper paper-supplying position shown by a full line in FIG. 12, whereby slightly pushing up the paper-supplying roller 1 by the papers 2 to apply a paper-supplying pressure to the papers 2, during the power source is switched on. And, when for example the power source is switched off or the papers 2 have been used or the papers 2 are exchanged, said lock is cancelled and thus the cassette plate 3*a* is moved downward to the lower drawing-out position shown by the two-dot chain line to push down the front end portion 51*b* of the lever member 51 in the above described manner, whereby rotating the lower separating roll 5 in the direction opposite to the paper-supplying direction.

On the other hand, as for the upper separating roll 4, a connecting member 19 (refer to FIG. 16) mounted on one end of the pivot 4*a* pivoted between the pivoting portions 47*a*, 47*a* of the frame member 47 is connected with a driving system provided in a body of an image-forming apparatus 21 when the cassette case 3 was inserted and rotatably driven in the paper-supplying direction together with the paper-supplying rollers 1, 1 when the copying-starting button was switched on, the pivot 1*a* of the respective paper-supplying rollers 1 (refer to FIG. 12) being pivoted on brackets 57, 57 swingably supported by the pivot 4*a* of the upper separating roll 4, both pivots 1*a*, 4*a* being interlocked through a gear, and the paper-supplying rollers 1, 1 being brought into contact with the upper surface of the papers 2 by the upward movement of the cassette case 3 to give a sufficient paper-supplying pressure to the papers 2 by their own weight.

With the overlapped transfer-preventing mechanism having the above described construction, at first when the cassette case 3 is drawn out (refer to FIG. 4) to carry the papers 2 on the cassette plate 3*a*, the front end portion 51*b* of the lever member 51 is pushed down by the lower portion of the front end of the cassette plate 3*a* to swingably move the lever member 51 to the position shown by the two-dot chain line in FIG. 12. Thus, at first the one-way clutch 53 is rotated counterclockwise to rotate the lower separating roll 5 together with the pivot 5*a* in the same direction (refer to FIG. 2), and at this time, the position where the lower separating roll 5 is brought into slidable contact with the papers 2 is slightly moved in the counterclockwise direction to change the position where the lower separating roll 5 is brought into slidable contact with the papers 2, whereby preventing the lower separating roll 5 from being biasedly worn.

And, the bracket 48 supporting the pivot 5*a* is rotated counterclockwise against the energizing force of the springs 50 to bring about the watch and wait condition that the spacers 46 are separated from the upper separating rolls 5 when the cassette plate 3*a* was further moved downward.

Then, when the cassette case 3 is inserted in the body of the image-forming apparatus 21 and the power source is switched on, the pushing-up member 56 is rotated upward to rise the front end portion of the cassette plate 3*a* (refer to the full line in FIG. 12), the upper surface of the papers 2 being brought into contact with the paper-supplying roller 1 to finish the preparation for the paper supply, and the paper-supply being started when the copying-starting button is pushed to carry out the copying operation. On the other hand, the front end portion 51*a* of the lever member 51 is returned to the position shown by the full line by a tension of a return spring 54 when the cassette plate 3*a* is risen. However, at this time, the one-way clutch 53 is rotated clockwise but a rotating power is not given to the pivot 5*a* and thus the pivot 5*a* is not rotated.

In the above described copying operation, both the paper-supplying roller 1 and the upper separating roll 4 are rotated in the paper-supplying direction to be brought into contact with the upper surface of the papers 2, whereby transferring the papers 2 in the paper-supplying direction 15, while, the lower separating roll 5 brought into contact with the lower surface of the papers 2 is connected with the one-way clutch 53 and the pin 52 is engaged with one end of the long hole 51*a* of the lever member 51 to regulate the clockwise rotation of the lever member 51, so that-the lower separating roll 5 is not rotated in the paper-supplying direction, in short clockwise, by a clutching function of the lever member 51. Thus, a larger slidable contact resistance is given to the lower surface of the papers 2 to treat the papers 2, whereby preventing the papers 2 from being overlappedly transferred.

When the papers 2 have been used, it is detected by a visual sensor arranged separately to move the cassette plate 3*a* downward to the lower drawing-out position. At this time, the front end portion 51*b* of the lever member 51 is pushed down by the front end portion of the cassette plate 3*a* (refer to the two-dot chine line in FIG. 12) and the lower separating roll 5 is rotated counterclockwise by 1/45 turn to move the point, at which the lower separating separating roll 5 is brought into slidable contact with the lower surface of the papers 2, as much as that. Thus, the lower separating roll 5 can be prevented from being biasedly worn. And, the bracket 48 is rotated counterclockwise by the further downward movement of the cassette plate 3*a* to bring about the watch and wait condition that the spacers 46 are separated from the upper separating rolls 5. Under this condition, the pressing of the spacers 46 against the upper separating rolls 4 is cancelled to prevent the upper separating roll 4 from being plastically deformed. In addition, also when the apparatus is packed up or the main power source is switched off, such the watch and wait condition is brought about to prevent the upper separating roll 4 from being deformed.

In addition, also in the case where the papers 2 are exchanged, when a hand is put on a handle 3*b* of the cassette case 3 (refer to FIG. 4), the cassette plate 3*a* is moved downward to the drawing-out position, so that the front end portion 51*b* of the lever member 51 is pushed down similarly to rotate the lower separating roll 5 counterclockwise by 1/45 turn and separate the spacers 46 from the upper separating rolls 4.

On the other hand, the distance between the upper separating roll 4 and the lower separating roll 5 can be very easily set by means of the spacers 46 in the manufacturing step and the aftercare step, so that the troublesome distance-regulating operation is not required. In addition, the actuator, such as solenoid and motor, is not required, the degree of freedom in layout being improved, and the cost being reduced by such the simple construction. In addition, although not shown, the separating mechanism-cancelling device according to the present invention can be applied also to the manual paper-supplying portion. In this case, it is sufficient that the contrarotating roll is rotated when the by-pass lift is descended.

As above described, according to the first invention, the other separating roll is supported so that the distance between both separating rolls may be regulatable, the pivot integrated with the other separating roll being provided with the gear, the ratchet corresponding to the gear being provided so as to be movable up and down, and the cam mounted on the pivot integrated with the rising member rising the paper-carrying plate up to the upper paper-supplying position being interlocked with the ratchet through the interlocking member to rotate the other separating roll in the direction opposite to the paper-supplying direction by the rising operation of the rising member regardless of the up and down position of the other separating roll, so that the distance between the upper separating roll and the lower separating roll can be regulated depending upon the thickness of the papers to carry out the surface-changing of the lower separating roll, whereby preventing the lower separating roll from being biasedly worn.

According to the second invention, the upper portion of the ratchet according to the first invention is extended upward, so that the front end of the papers can be stopped by the extended portion to prevent the papers from too deeply entering.

According to the third invention, the pivot integrated with the other separating roll is provided with the spacer, so that the distance between both separating rolls can be set at the appointed value by bringing the spacer into contact with one separating roll when assembled to make the troublesome regulation of distance unnecessary.

According to the fourth invention, when the paper-carrying plate is moved during the replenishment with the papers, the exchange of the papers or the watch and wait time, the separating member is operated to separate the spacer from one separating roll, so that the separating roll can be prevented from being plastically deformed and the suitable interval between both separating rolls can be always kept.

According to the fifth invention, the separating member is composed of lever member which is engaged with the paper-carrying plate to be operated when the paper-carrying plate is moved, so that the spacer can be surely separated from one separating roll by the simple construction.

According to the sixth invention, the other separating roll is adapted to be rotated in the direction opposite to the paper-supplying direction through the one-way clutch by means of the rotation-promoting member operated by the movement of the paper-carrying plate, so that the position where the other separating roll is brought into slidable contact with the papers can be changed to prevent the other separating roll from being biasedly worn and the spacer can be separated from one separating roll to prevent one separating roll also from being plastically deformed.

According to the seventh invention, the rotation-promoting member is composed of the lever member, which is engaged with the paper-carrying plate to be operated when the paper-carrying plate is moved, so that the surface-changing of the other separating roll and the separation of the spacer can be carried out by the simple construction requiring no space without using the actuator.

What is claimed is:

1. An overlapped transfer-preventing mechanism provided in an image-forming apparatus, in which a paper-carrying plate with the papers carried thereon is moved between an upper paper-supplying position and a lower non-paper-supplying position, comprising an upper rotably driven separating roll and a lower separating roll offset from said upper separating roll and supported so that an interval between both separating rolls may be regulated by the up or down position of the lower separating roll, a pivot integrated with the lower separating roll being provided with a gear, a ratchet movable up and down engaging said gear, and a cam mounted on a pivot integrated with a raising member which is adopted to raise said paper-carrying plate up to said upper paper-supplying position during a raising operation of said raising member, the cam being interlocked with said ratchet through an interlocking member to rotate the lower separating roll in the direction opposite to a paper-supplying direction by the raising operation of said raising member regardless of the up and down position of the lower separating roll.

2. An overlapped transfer-preventing mechanism as set forth in claim 1, characterized in the upper portion of the ratchet is extended upward and said extended upper portion is adopted to engage a front end of papers to stop said papers from being pushed into the interval between the upper and lower separating rolls when the interval between them is comparatively large and the paper-carrying plate is in the lower non-paper-supplying position.

* * * * *